US005810703A

United States Patent [19]

Stack

[11] Patent Number: 5,810,703

[45] Date of Patent: Sep. 22, 1998

[54] EXERCISE BOARD HAVING CENTRAL MOUNTING WITH MULTI-LEVEL ADJUSTABLE SPACER

[75] Inventor: Louis Stack, Alberta, Canada

[73] Assignee: Fitter International, Inc., Calgary, Canada

[21] Appl. No.: 691,279

[22] Filed: Aug. 1, 1996

[51] Int. Cl.[6] ..... A63B 22/16; A63B 22/14

[52] U.S. Cl. ..... 482/146; 482/51; 482/79

[58] Field of Search ..... 482/146, 147, 482/142, 79, 75, 51, 52, 148

[56] References Cited

U.S. PATENT DOCUMENTS

| | | | |
|---|---|---|---|
| 314,831 | 3/1885 | Hardy | 248/61 |
| 2,803,461 | 8/1957 | Coplin | 482/146 |
| 3,984,100 | 10/1976 | Firster | 482/146 |
| 4,193,592 | 3/1980 | Bishow | 482/142 |
| 5,536,226 | 7/1996 | Gordon | 482/146 |
| 5,599,258 | 2/1997 | Stone | 482/1 |

*Primary Examiner*—Richard J. Apley
*Assistant Examiner*—Denise Pothier
*Attorney, Agent, or Firm*—Townsend and Townsend and Crew LLP

[57] ABSTRACT

A wobble board is provided with the capability of varying the height between its sphere section and board. The wobble board includes a board with centrally protruding and downward extending bolt. A sphere section having legs, preferably four in number threads to the bolt. In between the sphere section and board underside, a variable height spacer is utilized. Preferably, the variable height spacer is provided with at least two sets of leg receiving notches. These sets of leg receiving notches are each at differing heights relative to the board. At the same time, the position of the notches within each set is complimentary in position to the legs. In operation, height between the sphere section and board is changed by unthreading the sphere section relative to the board without release of the variable height spacer between the sphere section and board. Unthreading continues until leg access to one set of the variable height notches occurs. Thereafter, the legs and spacer are tightened on the threaded attachment until the sphere section at the legs registers to the notches of one set on the spacer. Tightening continues until the sphere section, spacer, and board are locked in a unitary single piece. Exercise with the adjusted spacing between the sphere section and board can then occur.

6 Claims, 2 Drawing Sheets

EXERCISE BOARD HAVING CENTRAL MOUNTING WITH MULTI-LEVEL ADJUSTABLE SPACER

This invention relates to exercise boards having an exercise platform overlying a central pivot. Specifically, the following disclosure sets forth an exercise board with a pivot and spacer combination that permits adjustable exercise platform height with exercise board disassembly.

BACKGROUND OF THE INVENTION

So-called "wobble boards" of the circular variety are known. Specifically, a circular board defines an upper exercise surface and has a section of a sphere mounted on the under floor exposed side of the board. The person undertaking exercise stands or rests on the upward exercise surface. By "wobbling" the board to turn on its spherical central support, exercise can occur. For example, an injured and recovering basketball player can place an injured foot on such a device while shooting so-called "baskets" as part of a recovery program.

It has been found desirable to change the degree of difficulty of such a circular wobble board. This is most expeditiously done by changing the height between the bottom of the sphere section and the top of the circular wobble board. The greater the height between the bottom of the sphere and the top of the board, the more difficult exercise becomes. Utilizing the example immediately above, the basketball player would increase the height between the central pivot and the top of the wobble board as his injured ankle improves in recovery.

Unfortunately, changing the elevation between the sphere section and board has proved be other than trivial. Specifically, when it is remembered that this is an exercise device, and the full weight—both dynamic and static—of athletes are on the board, secure attachment of the sphere section with respect to the board is required. To meet this requirement, the usual practice has been to use different boards, each with its own different sphere section, to adjust board heights.

SUMMARY OF THE INVENTION

A wobble board is provided with the capability of varying the height between its sphere section and board. The wobble board includes a board with centrally protruding and downward extending bolt. A sphere section having legs, preferably four in number, threads to the bolt. In between the sphere section and board underside, a variable height spacer is utilized. Preferably, the variable height spacer is provided with at least two sets of leg receiving notches. These sets of leg receiving notches are each at differing heights relative to the board. At the same time, the position of the notches within each set is complimentary in position to the legs. In operation, height between the sphere section and board is changed by unthreading the sphere section relative to the board without release of the variable height spacer between the sphere section and board. Unthreading continues until leg access to one set of the variable height notches occurs. Thereafter, the legs and spacer are tightened on the threaded attachment until the sphere section at the legs registers to the notches of one set on the spacer. Tightening continues until the sphere section, spacer, and board are locked in a unitary single piece. Exercise with the adjusted spacing between the sphere section and board can then occur.

DESCRIPTION OF THE PREFERRED EMBODIMENT

Figure 2:
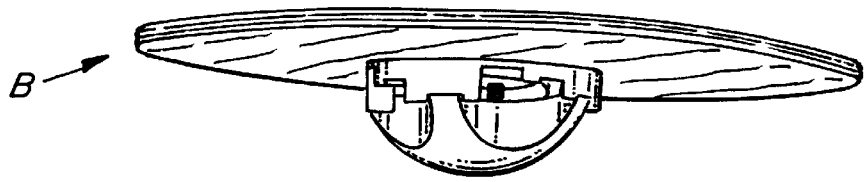
FIG. 2 is an assembled right side up perspective view with the truncated spherical section shown fitted to the medial step height defined by the spacer.
Figure 1:
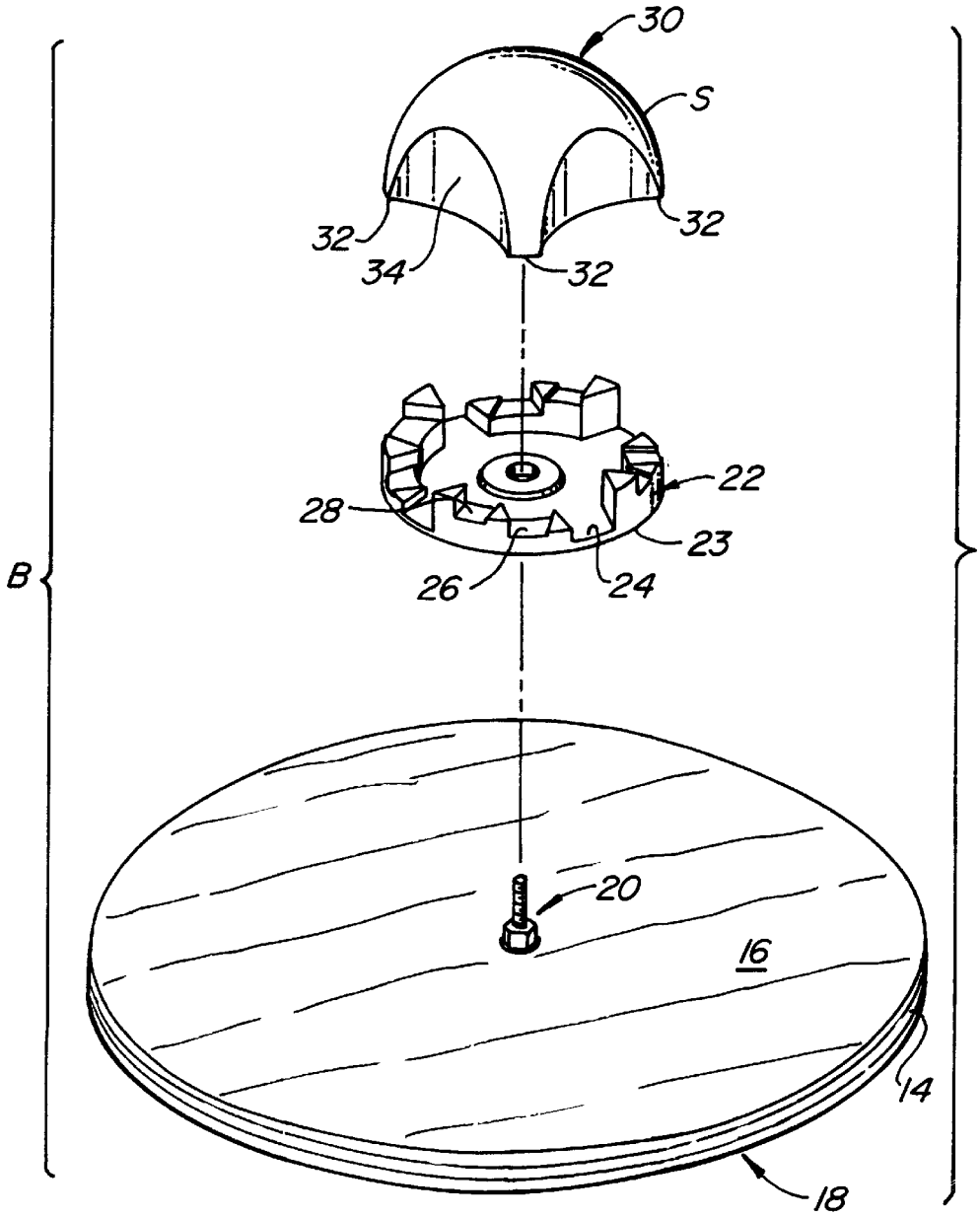
FIG. 1 is an upside down exploded perspective view of the exercise board, threaded bolt, spacer, and truncated spherical section.

Referring to FIGS. 1 and 2, the components of the circular wobble board B can be seen and identified. The circular wobble board B has circular board 14 defining board underside 16, and board exercise surface 18. Centrally of circular board 14 there protrudes threaded bolt 20, which is here shown fastened conventionally by a bolt and washer combination.

Spacer 22 has board bearing surface 23 for bearing on board underside 16 of circular board 14. As viewed in FIG. 1, opposite board bearing surface 23 spacer 22 defines three notch sets of four (4) notches each. Each notch set is at a differing elevation. As will hereinafter become apparent, each notch of the set of four notches receives one leg from spherical section S. For purposes of simplification, only one notch of each set of four is specifically identified; the reader will understand that the remaining notches are placed at 90° intervals.

Lower notch set 24 defines the minimum height spacing between spherical section S and board exercise surface 18; this is the "beginner" level for circular wobble board B. Medial notch set 26 defines the medium height spacing between spherical section S and board exercise surface 18; this is the "intermediate" level for circular wobble board B. Highest notch set 28 defines the highest height spacing between spherical section S and board exercise surface 18; this is the "advanced" level for circular wobble board B.

The reader will understand that only two (2) notch sets are required for the practice of this invention. We currently prefer three (3) such sets—each set being at a different elevation. Additional notch sets could as well be used.

Spherical section S can be easily understood. It includes truncated sphere portion 30 for bearing on the typically flat surface against which circular wobble board B is placed in use. Additionally, spherical section S includes four (4) legs 32 for being received in each of the sets of notches 24, 26, and 28. Finally, and in between respective legs 32, spherical section S defines sphere truncated intervals 34. These intervals permit spherical section S to span the unused notch sets when the device is in use. It will be understood that spherical section S contains female threads for threading to threaded bolt 20.

Referring to FIG. 2, assembly and use of circular wobble board B can readily be understood. Spherical section S is unscrewed with respect to threaded bolt 20. This causes legs 32 of spherical section S to raise relative to spacer 22 until one of the respective notch sets 24, 26, or 28 is received at legs 32 of spherical section S. When this occurs, unscrewing stops, and reverse downward and tightening screwing occurs. Both spherical section S and spacer 22 frictionally rotate relative to circular board 14 at board underside 16 until a friction locked position occurs. Upon occurrence of the frictionally locked position, circular wobble board B is ready for exercise.

Two important points need be made. First, each of notch sets 24, 26, and 28 have lower central portion 40, upper side restraining portion 42, and lower side restraining portion 44. When a leg 32 is in a notch, movement outside of the notch is inhibited. It has been found that such "notches" are to be preferred; otherwise during the dynamics of exercise movement, disengagement of legs 32 with the notches can occur.

Figure 3A:
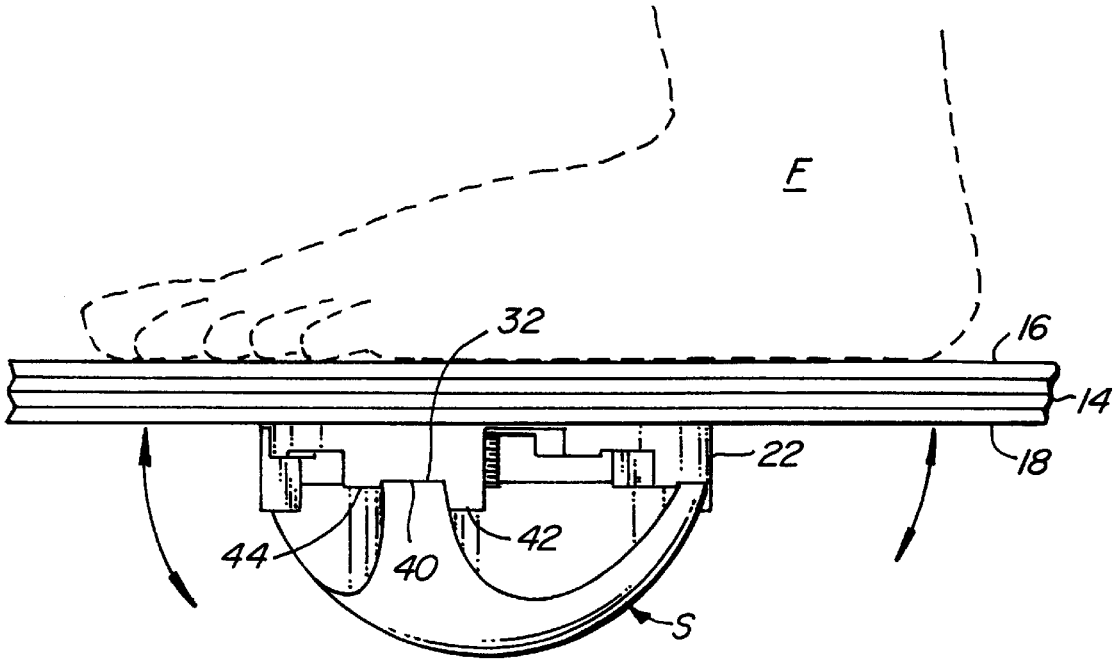
FIG. 3A is a side elevation similar to FIG. 2 with the height of the spacer at maximum height for maximum degree of difficulty.
Figure 3B:
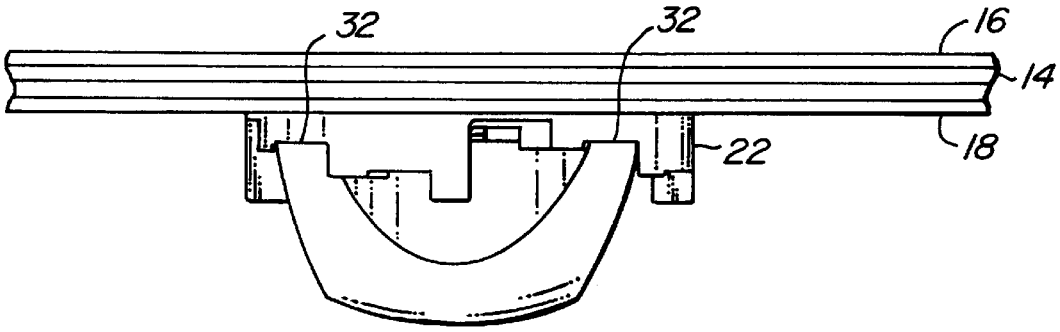
FIG. 3B is a side elevation similar to FIG. 3A with the height of the spacer at a medium height for an intermediate degree of difficulty; and, FIG. 3C is a side elevation similar to FIG. 3B with the height of the spacer at lowest height for the beginning degree of difficulty.
Figure 3C:
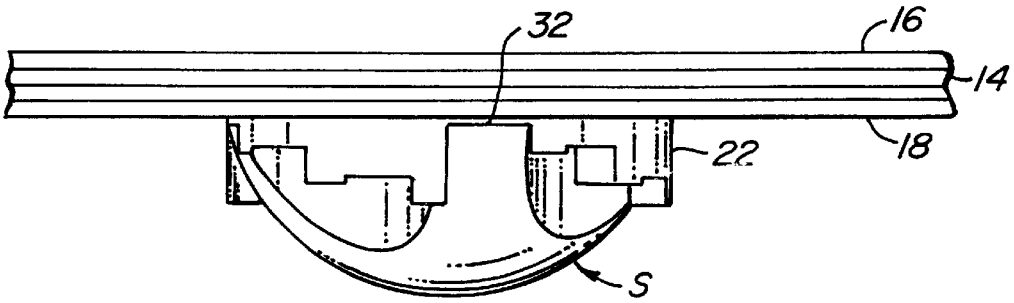

Secondly, and especially with respect to FIGS. 3A–3B it can be seen that sphere truncated intervals 34 between legs 32 of spherical section S effectively span over those notches that are not in use.

It will be understood that changing between lower notch set 24, medial notch set 26, and highest notch set 28, all requires only unscrewing of spherical section S relative to threaded bolt 20. Complete detachment of spherical section S from circular board 14 never occurs. This has been found highly advantageous as experience has proven that spacers requiring such disassembly rapidly become lost.

I have illustrated a threaded connection between the respective parts of this invention. It will be understood that other means of fastening will work as well. All kinds of mechanical fasteners will operate so long as the respective components of the exercise device are held firmly together.

What is claimed is:

1. In an exercise device having an upper supported board and a lower spherical sectioned pivot for enabling balanced exercise on the upper supported board over the lower spherical sectioned pivot, the improvement comprising:

means for adjustable tightening between the spherical sectioned pivot and the upper supported board for permitting attachment of the spherical sectioned pivot to the upper supported board at at least two different heights; and, a spacer for placement between the spherical sectioned pivot and the upper supported board;

the spacer defining at least two different spherical section receiving surfaces at two differing heights with respect to the upper supported board for enabling the spherical sectioned pivot to be supported at two different heights relative to the upper supported board; and, each spherical section receiving surface bounded by side restraining portions on either side for locking the pivot at one of the at least two different heights whereby upon adjustable tightening between the upper supported board, the spacer and the spherically sectioned pivot a unitary mass is formed.

2. In an exercise device according to claim 1 and wherein:

the spacer defining at least two different spherical section receiving surfaces defines three spherical section receiving surfaces at three different heights relative to the upper supported board.

3. In an exercise device according to claim 1 and wherein:

means for adjustable fastening between the spherical sectioned pivot and the upper supported board comprises a threaded attachment.

4. In an exercise device according to claim 1 and wherein:

the spherical sectioned pivot defines four feet and the adjustable spacer defines four'spherical section receiving surfaces, one such surface for receiving one of said feet.

5. A process for adjusting an exercise device having an upper supported board and a lower spherical sectioned pivot for enabling balanced exercise on the upper supported board over the lower spherical sectioned pivot, the process comprising the steps of:

providing means for adjustable fastening between the spherical sectioned pivot and the upper supported board for permitting attachment of the spherical sectioned pivot to the upper supported board at at least two different heights;

providing a spacer for placement between the spherical sectioned pivot and the upper supported board, the spacer defining at least two different spherical section receiving surfaces at two differing heights with respect to the upper supported board for enabling the spherical sectioned pivot to be supported at two different heights relative to the upper supported board, each spherical section receiving surface bounded by side restraining portions on either side for locking the pivot at one of the at least two different heights;

orienting the spherical sectioned pivot with respect to the spacer to permit the spacer to hold the spherical sectioned pivot at one elevation with respect to the upper supported board; and, tightening the means for adjustable fastening so that each spherical section receiving surface bounds the side restraining portions on either side when the upper supported board, the spacer and the spherically sectioned pivot form a unitary mass.

6. The process for adjusting an exercise device according to claim 5 and wherein:

the provided means for adjustable fastening between the spherical sectioned pivot and the upper supported board is a threaded attachment; and the step of tightening includes screwing the spherical sectioned pivot with respect to the upper supported board.

* * * * *